US008485793B1

(12) United States Patent
Sapir

(10) Patent No.: US 8,485,793 B1
(45) Date of Patent: Jul. 16, 2013

(54) CHIP SCALE VACUUM PUMP

(75) Inventor: Itzhak Sapir, Irvine, CA (US)

(73) Assignee: Aprolase Development Co., LLC, Wilmington, DE (US)

( * ) Notice: Subject to any disclaimer, the term of this patent is extended or adjusted under 35 U.S.C. 154(b) by 787 days.

(21) Appl. No.: 12/283,746

(22) Filed: Sep. 15, 2008

Related U.S. Application Data

(60) Provisional application No. 60/993,689, filed on Sep. 14, 2007.

(51) Int. Cl.
*F04B 3/00* (2006.01)
*F04B 5/00* (2006.01)

(52) U.S. Cl.
USPC ..... 417/244; 714/383; 714/389; 714/394; 714/395

(58) Field of Classification Search
USPC ..... 417/410.1, 412, 413.1–413.3, 322, 417/383, 389, 394–395, 53, 244, 436
See application file for complete search history.

(56) References Cited

U.S. PATENT DOCUMENTS

| | | | | |
|---|---|---|---|---|
| 3,656,873 | A * | 4/1972 | Schiff | 417/395 |
| 4,939,405 | A * | 7/1990 | Okuyama et al. | 310/330 |
| 5,542,821 | A * | 8/1996 | Dugan | 417/53 |
| 5,836,750 | A * | 11/1998 | Cabuz | 417/322 |
| 6,106,245 | A * | 8/2000 | Cabuz | 417/322 |
| 6,179,586 | B1 * | 1/2001 | Herb et al. | 417/480 |
| 6,714,138 | B1 * | 3/2004 | Turner et al. | 340/854.3 |
| 6,767,190 | B2 * | 7/2004 | Cabuz et al. | 417/53 |
| 7,064,472 | B2 * | 6/2006 | Pelrine et al. | 310/324 |
| 7,467,752 | B2 * | 12/2008 | Sweeton | 239/102.2 |
| 7,517,201 | B2 * | 4/2009 | Cabuz et al. | 417/413.2 |
| 7,631,852 | B2 * | 12/2009 | Richter et al. | 251/61.1 |
| 7,802,970 | B2 * | 9/2010 | Singhal et al. | 417/48 |
| 7,832,429 | B2 * | 11/2010 | Young et al. | 137/829 |
| 2001/0014286 | A1 * | 8/2001 | Peters et al. | 417/53 |
| 2003/0129064 | A1 * | 7/2003 | Cabuz et al. | 417/53 |
| 2004/0000843 | A1 * | 1/2004 | East | 310/331 |
| 2004/0115068 | A1 * | 6/2004 | Hansen et al. | 417/379 |
| 2005/0287020 | A1 * | 12/2005 | Lee et al. | 417/413.2 |
| 2006/0147325 | A1 * | 7/2006 | Vogeley | 417/413.2 |
| 2007/0243084 | A1 * | 10/2007 | Vogeley | 417/413.2 |
| 2008/0101965 | A1 * | 5/2008 | Zhang | 417/413.2 |
| 2009/0087323 | A1 * | 4/2009 | Blakey et al. | 417/413.2 |
| 2009/0128922 | A1 * | 5/2009 | Justis et al. | 359/666 |
| 2009/0196778 | A1 * | 8/2009 | Kitahara et al. | 417/540 |
| 2009/0232680 | A1 * | 9/2009 | Kitahara et al. | 417/413.2 |
| 2011/0070110 | A1 * | 3/2011 | Hirata | 417/413.2 |

* cited by examiner

*Primary Examiner* — Anne Hines
*Assistant Examiner* — Jose M Diaz

(57) ABSTRACT

A chip scale structure fabricated from known MEMS processes is provided including a pump actuator, a pump volume, pump membrane, a valve membrane, a valve aperture, and a valve actuator. The pump actuator may include a piezoelectric or piezoceramic disk. The valve actuator may be a piezoelectric or piezoceramic disk. A manifold plate with a valve aperture is disposed between the pump membrane and the valve membrane. One or more vacuum chambers are provided along a vacuum flow path or conduit in communication with the one or more vacuum chambers. The flow path comprises an inlet port and an outlet port where the inlet port is in communication with the separately provided vacuum environment. The outlet port is in commemoration with an external environment (e.g. non or lower-vacuum environment) for exhausting gases that are pulled from the separately provided vacuum environment to a separate location.

41 Claims, 2 Drawing Sheets

CHIP SCALE VACUUM PUMP

CROSS REFERENCE TO RELATED APPLICATIONS

This application claims priority to provisional application No. 60/993,689, filed Sep. 14, 2007 entitled "Chip Scale Vacuum Pump" and which is fully incorporated herein by reference.

STATEMENT REGARDING FEDERALLY SPONSORED RESEARCH AND DEVELOPMENT

Not applicable

BACKGROUND OF THE INVENTION

1. Field of the Invention

The invention generally relates to the field of vacuum pumps. Specifically, the invention relates to a chip scale vacuum pump comprising piezoelectric pumping and valving functions.

2. Description of the Prior Art

Generation of vacuum environments and the sealing of vacuumed devices during fabrication and production are common techniques and in most cases, the size and power consumption of the vacuum pumps used for these operations are not relevant as they are not a part of the end item in which the vacuum aspect in utilized. Nonetheless, there exist certain processes that require a vacuum environment be achieved during device operation in the field and away from large production-line vacuum pumps. These processes, for instance may involve the sampling of matter (e.g., gases, chemicals, etc.) in the field and require reaching a vacuum environment in a small portable system.

There exists numerous vacuum pump technologies but these prior art devices are not easily scalable or well-suited to chip scale size (i.e., microelectronic integrated circuit scale) and in particular, not well-suited when relatively high vacuum levels are needed. The unavailability of chip scale size vacuum pumps poses a significant obstacle in achieving small, portable diagnostic/analysis systems that require vacuum environments for operation.

What is needed is a small vacuum pump that comprises a close-to-zero leakage sealing feature and that has an effective vacuum capability, high flow rate, low power and that has the ability to be mounted in a chip scale package format such as an integrated circuit chip on a substrate.

The disclosed invention provides for a chip scale vacuum pump to address the above prior art deficiencies and the lack of small, hand-held, low-power, fieldable diagnostic and analysis systems or other applications requiring small, portable vacuum environments.

SUMMARY OF THE INVENTION

A chip scale structure, such as a micro-electro-mechanical system structure fabricated from known MEMS processes is provided comprising at least one pump actuator, at least one pump volume, and at least one pump membrane. The pump actuator preferably comprises a piezoelectric or piezoceramic disk capable of deforming in a convex or concave manner when a predetermined voltage is applied thereto. The resulting piezoelectric disk deformation is used to drive the pump membrane.

The invention further comprises at least one valve membrane, at least one valve aperture and at least one valve actuator. The valve actuator is preferably a piezoelectric or piezoceramic disk. A manifold plate with a valve aperture is disposed between the pump membrane and the valve membrane.

One or more vacuum chambers are provided along a vacuum flow path or conduit that is in communication with the one or more vacuum chambers. The flow path comprises an inlet port and an outlet port where the inlet port is in communication with the separately provided vacuum environment. The outlet port is in communication with an external environment (i.e., non- or lower-vacuum environment) for exhausting the gases that are pulled from the separately provided vacuum environment to a separate location.

DETAILED DESCRIPTION OF THE PREFERRED EMBODIMENTS OF THE INVENTION

A preferred embodiment of the disclosed chip scale vacuum pump (CSVP) comprises a chip scale, (e.g., and by way of example and not a limitation, a 22 mm×22 mm×1.6 mm, low vacuum (e.g., 10 milli-Torr), high flow rate (e.g., 8 ml/min)) vacuum pump that is suitable for use in relatively small systems and is in communication with an external vacuum chamber or environment for achieving a vacuum therein.

The CSVP invention herein achieves its small size and high vacuum characteristics by employing a number of novel structural and functional aspects.

A first novel aspect of the invention is a chained, multi-stage pump and valve structure and function. In a preferred embodiment as illustrated in the figures, six valve stages are provided in the CSVP structure. This multi-stage structure allows the CSVP to gradually achieve a high vacuum by substantially separating the various valve stages and by reaching a relative vacuum differential between each of two stages dictated by the pump's compression ratio. This is achieved in a sequential manner as is further discussed below.

A second novel aspect of the invention is the incorporation of very closely spaced (100 μm) pumps/valves in a double sided configuration upon a substrate. This aspect desirably provides the ability to reduce the "dead" volume of the pump space to such a small absolute value that a large compression ratio (30:1) is achievable even with a small stroke volume.

A third novel aspect of the invention is the use of piezoelectric or piezoceramic disks acting as piezohydraulic actuators both in the pump and valving stages to achieve the above benefits. For ease of reference, the actuators in the specification shall be referred to as piezo actuators but it is understood that any equivalent structure such as piezoelectric or piezoceramic actuators may be use.

The above referenced "piezohydraulic" actuation is a relatively new technology involving micro-scale hydraulic actuators. The piezohydraulic actuator of the invention can generate relatively large forces (sub-Newtons) by combining the effects of a piezoelectric actuator with a micro-hydraulic force converter. A piezoelectric disk is fixedly supported over a sealed fluid volume. When the piezoelectric disk is electrically actuated by means of a predetermined electrical signal, the piezoelectric disk will deform in an "out of the plane" direction, i.e., inwardly or outwardly against the sealed fluid volume. The resulting deformation creates a variable compression on the sealed fluid volume, generating a hydraulic pressure.

Figure 1:
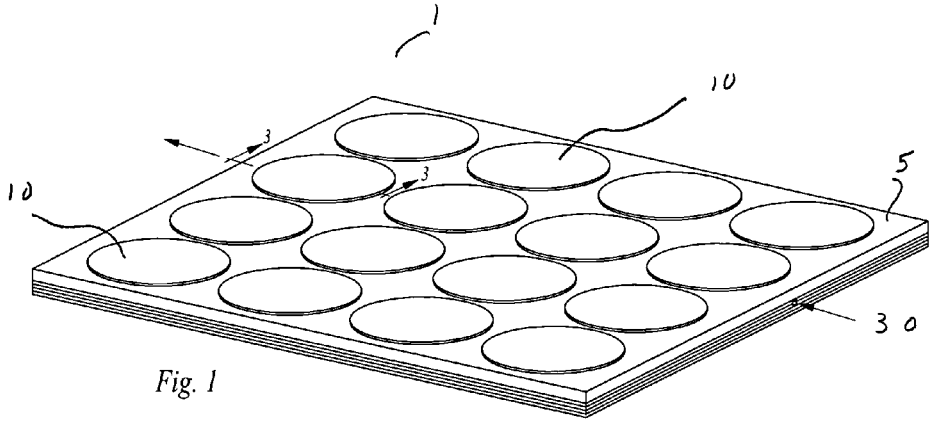
FIG. 1 illustrates a top view of the chip scale vacuum pump of the invention.
Figure 2:
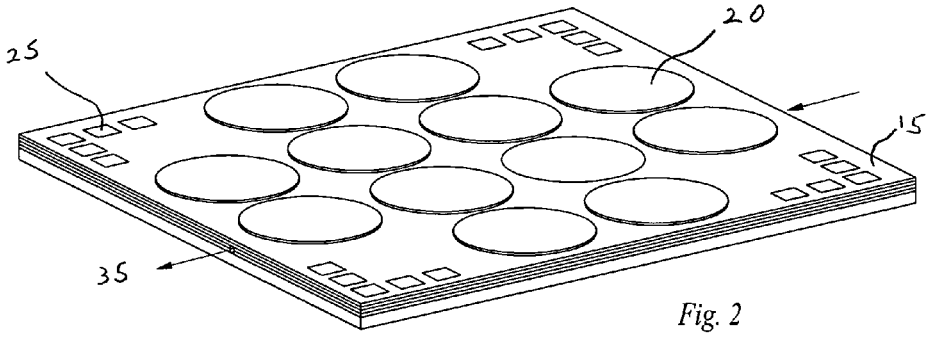
FIG. 2 illustrated a bottom view of the chip scale vacuum pump of the invention.

Turning now to the figures wherein like numerals designate like elements among the several views, FIGS. 1 and 2 illustrate a preferred embodiment of the CSVP 1 of the disclosed invention. First surface 5 comprises one or more pump piezo actuators 10 and second surface 15 comprises one or more valve piezo actuators 20. Wire bond pads 25 are provide of the routing of electrical signals, power, ground and the like to, from and between the various elements of the invention.

Inlet port 30 provides an aperture for adapting to a vacuum environment and through which the pump's vacuum is drawn. Outlet port 35 functions as an exhaust port for removing drawn gas from the vacuum environment to an external location.

Figure 3:
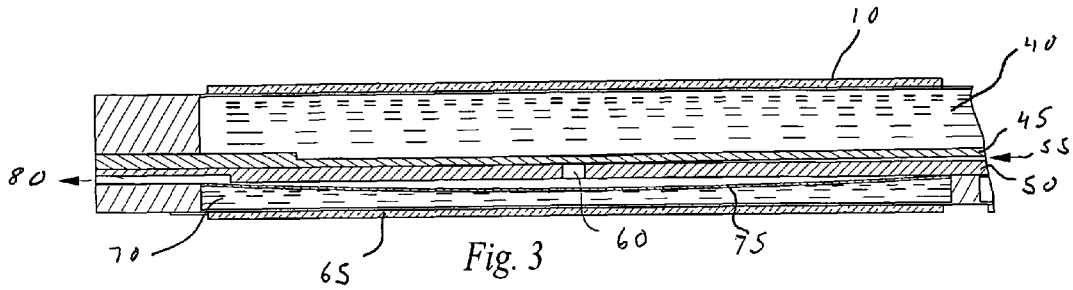
FIG. 3 illustrates a cross-section of 3-3 of FIG. 1 of the chip scale vacuum pump of the invention.

Turning to FIG. 3, a cross-section of FIG. 1 is shown. As is illustrated, the cross-section reflects a pump piezo actuator 10 bonded upon first surface 5 to a sealed first fluid volume 40 whereby an inward deflection of pump piezo actuator 10 compresses upon first fluid volume 40.

Disposed below first fluid volume 40 is a deformable, flexible pump membrane 45 comprised, for instance of a polysilicon material. In this configuration, when pump piezo actuator 10 is deformed inwardly toward pump membrane 45 by the application of a predetermined voltage, the deflection force is transferred to first fluid volume 40 whereby pump membrane is urged inwardly upon manifold plate 50.

In the above manner, the total volume of pumped volume 55 may be selectively varied dependant upon the deflection position of pump piezo actuator 10 up to and including the urging of pump membrane 45 against valve aperture 60 whereby a seal of valve aperture 60 is achieved.

Second surface 15 comprises one or more valve piezo actuators 65A-65L bonded upon a sealed second fluid volume 70. Disposed above second fluid volume 70 is a deformable, flexible valve membrane 75 comprised, for instance of a polysilicon material. When valve piezo actuator 65 is deformed outwardly (i.e., deflected) by application of a predetermined voltage, the deflection force from that valve piezo actuator is transferred to second fluid volume 70 whereby the total volume of exhaust volume 80 may be varied dependant upon the deflection position of valve piezo actuator 65.

Figure 4:
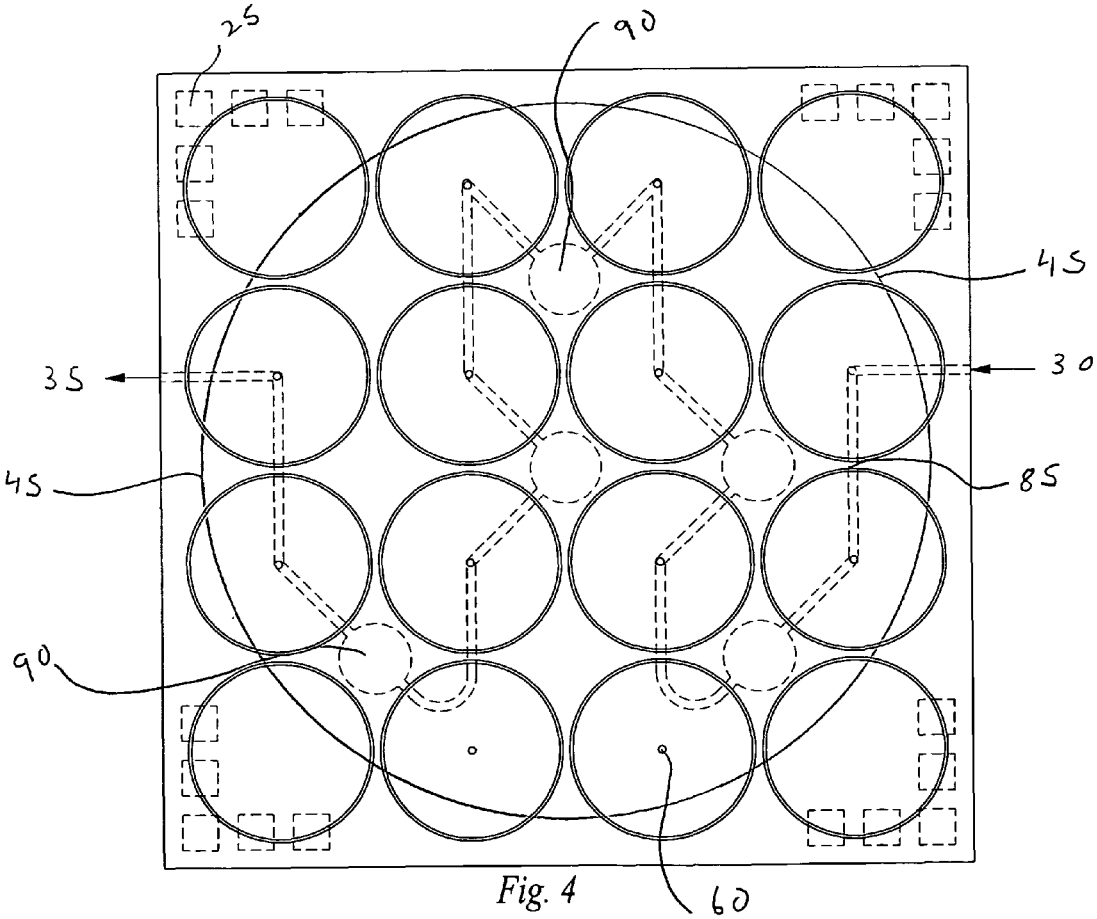
FIG. 4 illustrates a transparent view of the chip scale vacuum pump of the invention and shows the vacuum flow path and vacuum chambers therein.

With respect to FIG. 4, a transparent view of CSVP 1 illustrating the elements of first surface 5 and second surface 15 and reflecting flow conduit 85 in communication with one or more vacuum chambers 90 is shown.

The piezo actuators of the invention can desirably be deformed at relatively high frequencies (e.g., 1 KHz in the CSVP) and the actuation force can be amplified or reduced by designing the surface area ratio of the various piezoelectric actuators and the respective actuated membranes upon which the actuators operate.

As is seen in FIG. 3 and FIG. 4, the hydraulic pressure produced by the respective piezo actuators is transferred to the respective silicon membranes.

The illustrated embodiment reflects a single pump membrane 45 that is actuated by 16 pump piezo actuators working synchronously generate a large hydraulic volume displacement. It is to be noted that configurations varying the number of the above elements are within the contemplated scope of the invention.

The various valve membranes 75 are shown as a set of 12 smaller valve membranes with individually controlled valve piezo actuators 65. The preferred embodiment of the illustrated valve piezo actuator desirably is designed to generate out of plane deformations/deflections in the range of 6 μm over 20 mm diameter span in the valve pump membrane. The use of polysilicon as the pump membrane construction material ensures that structural integrity of the CSVP is maximized.

The CSVP works in a sequence/series of pumping and valving operations.

In an exemplar set of pumping and valving operations, pump membrane 45 is biased by means of a predetermined electrical signal so as to effectively seal valve aperture 60 after which valve membrane 75 is opened by means of a predetermined electrical signal.

Next in the sequence, all pump piezo actuators are biased upwardly by means of a predetermined electrical signal. Next in the sequence, valve membrane 75 is closed by means of a predetermined electrical signal and the valve aperture in the adjacent pump element in the exhaust flow path is opened by means of a predetermined electrical signal. At this point in the pumping/valving cycle, the pump membrane is biased inwardly by means of a predetermined electrical signal and valve aperture in the adjacent pump element is closed. In this manner, the pumped gas from the vacuum environment is transferred to the one or more vacuum chambers 90 in a bucket brigade fashion for removal to an external location. The sequence continues until that incremental volume of air moves through all the stages and is evacuated into the ambient. The vacuum in the external vacuum environment gradually increases until the maximum vacuum level is achieved. At a predetermined point in the sequence, all valves in the CSVP are closed to ensure vacuum seal.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

I claim:

1. A chip-scale pump device comprising:

a first piezo actuator associated with a first chamber, the first chamber having an input port and a pump membrane, wherein the first piezo actuator and the pump membrane are separated by a first hydraulic volume; and a second piezo actuator associated with a second chamber, the second chamber having an output port;

wherein the first and second chambers are connected by a valve aperture, and wherein at least one of the first piezo actuator or the second piezo actuator includes at least one of a piezoelectric element or a piezoceramic element.

2. The chip-scale pump device of claim 1, wherein the first and second chambers are separated from each other by a manifold plate that comprises the valve aperture.

3. The chip-scale pump device of claim 2, wherein the first chamber comprises the manifold plate, and wherein the second chamber comprises a valve membrane and the manifold plate.

4. The chip-scale pump device of claim 3, wherein the pump membrane and the valve membrane each comprise a polysilicon material.

5. The chip-scale pump device of claim 3, wherein the second piezo actuator and the valve membrane are separated by a second hydraulic fluid volume.

6. The chip-scale pump device of claim 5, wherein the first and second hydraulic fluid volumes are filled with hydraulic fluid.

7. The chip-scale pump device of claim 5, wherein the first and second piezo actuators each comprise a piezoceramic actuator.

8. The chip-scale pump device of claim 1, wherein the first piezo actuator is located on a first side of a substrate and the second piezo actuator is located on a second side of the substrate.

9. The chip-scale pump device of claim 1, wherein the first chamber has a compression ratio of about 30:1 and a diameter of about 100 micrometers.

10. The chip-scale pump device of claim 1, wherein the first and second chambers are formed using microelectromechanical systems techniques.

11. A chip-scale pump system comprising:

a plurality of micro-pumps connected in series, individual of the plurality of micro-pumps including:

a first piezo-hydraulic actuator associated with a first chamber, the first chamber having an input port; and a second piezo-hydraulic actuator associated with a second chamber, the second chamber having an output port;

wherein the first and second chambers are connected by a valve aperture, and wherein at least one of the first piezo-hydraulic actuator or the second piezo-hydraulic actuator includes at least one of a piezoelectric element or a piezoceramic element; and an intermediate chamber connected to the input port of a first micro-pump of the plurality of micro-pumps and to the output port of a second micro-pump of the plurality of micro-pumps.

12. The chip-scale pump system of claim 11, wherein the intermediate chamber is configured to be pressurized when the first piezo-hydraulic actuator of the second micro-pump compresses a gas in the first chamber of the second micro-pump to expel the gas through the output port of the second micro-pump and into the intermediate chamber.

13. The chip-scale pump system of claim 11, further comprising a chamber connected to at least one of the plurality of micro-pumps.

14. The chip-scale pump system of claim 13, wherein the chamber is configured to be pressurized by at least one of the plurality of micro-pumps.

15. The chip-scale pump system of claim 13, wherein the chamber is configured to be depressurized by at least one of the plurality of micro-pumps.

16. The chip-scale pump system of claim 11, wherein the plurality of micro-pumps are located on a chip.

17. The chip-scale pump system of claim 11, further comprising a plurality of contact pads, each of the contact pads electrically connected to a terminal of the first piezo-hydraulic actuator of each of the plurality of micro-pumps.

18. The chip-scale pump system of claim 11, wherein the first and second chambers of each of the plurality of micro-pumps are separated by a manifold plate that comprises the valve aperture.

19. A chip-scale pump system comprising:

a plurality of micro-pumps connected in series, individual of the plurality of micro-pumps including:

a first piezo-hydraulic actuator associated with a first chamber, the first chamber having an input port; and a second piezo-hydraulic actuator associated with a second chamber, the second chamber having an output port;

wherein the first and second chambers are connected by a valve aperture, and wherein at least one of the first piezo-hydraulic actuator or the second piezo-hydraulic actuator includes at least one of a piezoelectric element or a piezoceramic element; and wherein the first and second piezo-hydraulic actuators of individual of the plurality of micro-pumps comprise a piezo actuator, a hydraulic fluid volume, and a membrane.

20. The chip-scale pump system of claim 19, wherein the piezo actuator comprises a piezoceramic actuator.

21. The chip-scale pump system of claim 11, wherein the first piezo-hydraulic actuator of each of the plurality of micro-pumps is located on a first side of a substrate and the second piezo-hydraulic actuator of each of the plurality of micro-pumps is located on a second side of the substrate.

22. The chip-scale pump system of claim 11, wherein each of the plurality of micro-pumps has a compression ratio of about 30:1 and a diameter of about 100 micrometers.

23. A method of operating a chip-scale pump comprising:

actuating a first piezo actuator to expand a first chamber, the first chamber having an input port, wherein said actuating the first piezo actuator comprises deflecting the first piezo actuator to deflect a membrane hydraulically coupled to the first piezo actuator by a hydraulic fluid in a hydraulic fluid volume separating the first piezo actuator and the membrane;

actuating a second piezo actuator to open a second chamber, the second chamber having an output port, wherein the first and second chambers are connected by a valve aperture, and wherein at least one of the first piezo actuator or the second piezo actuator includes at least one of a piezoelectric element or a piezoceramic element; and actuating the first piezo actuator to compress the first chamber.

24. The method of claim 23, further comprising actuating the second piezo actuator to close the second chamber.

25. The method of claim 24, wherein the second piezo actuator seals against the valve aperture.

26. The method of claim 23, wherein said actuating the first piezo actuator to expand the first chamber causes a fluid to enter the first chamber through the input port, and wherein said actuating the first piezo actuator to compress the first chamber expels the fluid through the output port.

27. The method of claim 26, wherein the fluid is a gas.

28. The method of claim 26, further comprising:

actuating a third piezo actuator to expand a third chamber connected to the output port of the second chamber to cause the fluid to enter the third chamber;

actuating the second piezo actuator to close the second chamber;

actuating a fourth piezo actuator to open a fourth chamber having a second output port, wherein the third and fourth chambers are connected by a second valve aperture; and actuating the third piezo actuator to compress the third chamber to expel the fluid through the second valve aperture and into the fourth chamber.

29. The method of claim 23, wherein the first and second chambers are separated by a manifold plate that comprises the valve aperture.

30. The method of claim 29, wherein the first chamber comprises a pump membrane and the manifold plate, and wherein the second chamber comprises a valve membrane and the manifold plate.

31. The method of claim 23, wherein the second piezo actuator, the second chamber, and the valve aperture form a valve.

32. The method of claim 23, further comprising cycling the first piezo actuator and the second piezo actuator at about 1 kHz.

33. The method of claim 23, wherein said actuating the first piezo actuator to expand the first chamber depressurizes a third chamber connected to the input port.

34. The method of claim 23, wherein said actuating the first piezo actuator to compress the first chamber expels the fluid from the first chamber through the second chamber and into a third chamber connected to the output port.

35. A method of operating a chip-scale pump system, the chip-scale pump system comprising a plurality of micro-pumps, individual of the plurality of micro-pumps including a pump portion comprising a first piezo-hydraulic actuator and an input port, and a valve portion comprising a second piezo-hydraulic actuator and an output port, the compression and valve portions connected by a valve aperture, the method comprising:

closing a first valve portion of a first micro-pump of the plurality of micro-pumps;

opening a second valve portion of a second micro-pump of the plurality of micro-pumps;

expanding the pump portion of the first micro-pump;

closing the second valve portion of the second micro-pump;

opening the first valve portion of the first micro-pump; and compressing the pump portion of the first micro-pump, wherein said compressing the pump portion of the first micro-pump pressurizes a chamber of the chip-scale pump system;

wherein at least one of the first piezo-hydraulic actuator or the second piezo-hydraulic actuator includes at least one of a piezoelectric element or a piezoceramic element.

36. The method of claim 35, wherein said expanding the pump portion of the first micro-pump causes a gas to enter the pump portion of the first micro-pump from the output port of the second micro-pump through the input port of the first micro-pump, and wherein said compressing the pump portion of the first micro-pump causes the gas to exit the pump portion of the first micro-pump through the output port of the first micro-pump.

37. The method of claim 36, further comprising cycling the pump portions and the valve portions of the chip-scale pump system to direct the gas through the output port of the first micro-pump at a flow rate of about 8 milliliters per minute.

38. The method of claim 35, wherein the chip-scale pump system further comprises a chamber, wherein said expanding the pump portion of the first micro-pump places a vacuum on the chamber.

39. The method of claim 35, further comprising closing the valve portion of each of the plurality of micro-pumps to seal the chip-scale pump system.

40. The method of claim 35, wherein the first and second piezo-hydraulic actuators each comprise a piezo actuator, a hydraulic fluid volume, and a membrane.

41. The method of claim 35, wherein the pump portion has a diameter of about 100 micrometers and the valve portion has a diameter of about 20 micrometers.

* * * * *